US009437382B2

(12) United States Patent
Kato et al.

(10) Patent No.: US 9,437,382 B2
(45) Date of Patent: Sep. 6, 2016

(54) ELECTROMAGNET DEVICE AND ELECTROMAGNETIC RELAY USING THE SAME

(71) Applicant: OMRON Corporation, Kyoto-Shi, Kyoto (JP)

(72) Inventors: Tatsuro Kato, Shiga (JP); Masaaki Yamamoto, Osaka (JP); Kazuya Murakami, Shiga (JP); Kazuki Tsujikawa, Kumamoto (JP); Daisuke Narimatsu, Kumamoto (JP); Shinya Matsuo, Kumamoto (JP); Harumichi Kitaguchi, Shiga (JP); Toshifumi Sumino, Osaka (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 14/334,560

(22) Filed: Jul. 17, 2014

(65) Prior Publication Data

US 2015/0054603 A1 Feb. 26, 2015

(30) Foreign Application Priority Data

Aug. 23, 2013 (JP) ..... P2013-173817

(51) Int. Cl.
*H01H 51/22* (2006.01)
*H01H 50/44* (2006.01)
*H01F 5/04* (2006.01)

(52) U.S. Cl.
CPC ..... *H01H 50/443* (2013.01); *H01F 5/04* (2013.01); *H01H 2050/446* (2013.01)

(58) Field of Classification Search
CPC ..... H01H 50/443; H01H 50/643; H01H 50/642; H01H 50/36; H01H 2050/446; H01H 51/22; H01H 51/2227
USPC ..... 335/78
See application file for complete search history.

(56) References Cited

U.S. PATENT DOCUMENTS

| | | | | | |
|---|---|---|---|---|---|
| 2,735,968 | A | * | 2/1956 | Bogue et al. | 335/275 |
| 4,302,742 | A | * | 11/1981 | Schedele | 335/202 |
| 4,618,842 | A | * | 10/1986 | Nestlen et al. | 335/128 |
| 4,758,809 | A | * | 7/1988 | Bell | 335/128 |
| 4,761,627 | A | * | 8/1988 | Bell | 335/128 |

(Continued)

FOREIGN PATENT DOCUMENTS

| | | | |
|---|---|---|---|
| CN | 1694204 | A | 11/2005 |
| EP | 1953785 | A2 | 8/2008 |
| JP | 2005-183554 | A | 7/2005 |

OTHER PUBLICATIONS

Extended European Search Report issued in corresponding European Application No. 14175152.9, mailed on Jan. 8, 2015 (6 pages).

(Continued)

*Primary Examiner* — Shawki S Ismail
*Assistant Examiner* — Lisa Homza
(74) *Attorney, Agent, or Firm* — Osha Liang LLP

(57) ABSTRACT

An electromagnet device has a spool having a guard portion at at least one end thereof, a coil wound around a body portion of the spool, and a coil terminal press-fitted in the guard portion. A lead wire of the coil is tied up to a tying-up portion of the coil terminal projected from the guard portion. The tying-up portion is folded toward the guard portion of the spool after the lead wire of the coil is tied up to the tying-up portion of the coil terminal extending in a direction receding from the spool.

13 Claims, 8 Drawing Sheets

(56) References Cited

U.S. PATENT DOCUMENTS

| | | | | |
|---|---|---|---|---|
| 4,825,179 | A * | 4/1989 | Nagamoto et al. | 335/80 |
| 4,958,137 | A * | 9/1990 | Schroeder | 335/128 |
| 5,160,910 | A * | 11/1992 | Tsuji | 335/129 |
| 5,202,663 | A * | 4/1993 | Tomono et al. | 335/86 |
| 5,204,647 | A * | 4/1993 | Mitsuki et al. | 335/80 |
| 5,289,144 | A * | 2/1994 | Liao | 335/78 |
| 5,321,377 | A * | 6/1994 | Aharonian | 335/78 |
| 5,392,015 | A * | 2/1995 | Matsuoka et al. | 335/78 |
| 5,572,176 | A * | 11/1996 | Heinzl et al. | 335/129 |
| 5,680,082 | A * | 10/1997 | Stocklin | 335/128 |
| 5,757,255 | A * | 5/1998 | Noda et al. | 335/78 |
| 5,805,040 | A * | 9/1998 | Corcoran | 335/202 |
| 5,864,270 | A * | 1/1999 | Hoffman | 335/78 |
| 5,874,876 | A | 2/1999 | Kobayashi et al. | |
| 5,907,268 | A * | 5/1999 | Mader | 335/202 |
| 6,034,582 | A * | 3/2000 | Fausch | 335/78 |
| 6,323,747 | B1 * | 11/2001 | Mader et al. | 335/80 |
| 6,486,760 | B2 * | 11/2002 | Miyazaki et al. | 335/78 |
| 6,606,018 | B2 * | 8/2003 | Takano et al. | 335/78 |
| 6,731,190 | B2 * | 5/2004 | Yamashita et al. | 335/78 |
| 7,205,870 | B2 * | 4/2007 | Sanada et al. | 335/78 |
| 7,471,179 | B2 * | 12/2008 | Hatakeyama et al. | 336/192 |
| 7,477,119 | B2 * | 1/2009 | Wu | 335/83 |
| 7,679,476 | B2 * | 3/2010 | Kubono et al. | 335/78 |
| 7,750,769 | B2 * | 7/2010 | Minowa et al. | 335/78 |
| 7,859,371 | B2 * | 12/2010 | Takano | 335/78 |
| 7,994,884 | B2 * | 8/2011 | Kuo | 335/78 |
| 8,111,117 | B2 * | 2/2012 | Minowa et al. | 335/78 |
| 2003/0231090 | A1 * | 12/2003 | Copper et al. | 335/128 |
| 2005/0242907 | A1 | 11/2005 | Minowa et al. | |
| 2008/0180197 | A1 * | 7/2008 | Kubono et al. | 335/78 |
| 2014/0055223 | A1 * | 2/2014 | Sumino et al. | 335/229 |
| 2015/0042425 | A1 * | 2/2015 | Sumino et al. | 335/189 |
| 2015/0054603 | A1 * | 2/2015 | Kato et al. | 335/2 |

OTHER PUBLICATIONS

First Office Action issued in corresponding Chinese Application No. 201410374108.7, mailed on Jan. 6, 2016 (8 pages).

* cited by examiner

ELECTROMAGNET DEVICE AND ELECTROMAGNETIC RELAY USING THE SAME

BACKGROUND

1. Field

The present invention relates to an electromagnet device, particularly to a coil terminal attaching structure.

2. Related Art

Conventionally, as to the electromagnet device, for example, Japanese Unexamined Patent Publication No. 2005-183554 discloses a coil block including a coil bobbin, a coil formed by winding a coil wire around the coil bobbin, and at least three coil terminals to which the coil wire is connected, the coil terminals being projected in substantially parallel toward the same direction from a base of the coil bobbin. In the coil block, a part of an inner coil terminal of the coil terminals projected in parallel is bent and raised near the base to form a projection having a shape accommodated in a width in a direction orthogonal to an extending direction of the coil terminals, and the coil wire is welded to the projection while tied up to the projection.

In the coil block, as illustrated in FIGS. 5 to 7 of Japanese Unexamined Patent Publication No. 2005-183554, lead wires of the two coils wound around the coil bobbin are electrically connected to tying-up portions of the three coil terminals provided in parallel in the coil bobbin.

SUMMARY

However, because the adjacent coil terminals are close to each other in the coil block, unfortunately the tying-up portion of the coil terminal cannot be enlarged, but work to tie up the lead wire of the coil is hardly performed.

One or more embodiments of the present invention provides an electromagnet device in which the work to tie up the lead wire of the coil is easily performed even if the adjacent coil terminals are close to each other.

In accordance with one or more embodiments of the present invention, an electromagnet device includes: a spool including a guard portion at at least one end, a coil being wound around a body portion of the spool; and a coil terminal press-fitted in the guard portion. In the electromagnet device, a lead wire of the coil is tied up to a tying-up portion of the coil terminal projected from the guard portion, and the tying-up portion is folded toward the guard portion of the spool after the lead wire of the coil is tied up to the tying-up portion of the coil terminal extending in a direction receding from the spool.

Accordingly, the tying-up portion is folded toward the guard portion after the lead wire of the coil is tied up to the tying-up portion of the coil terminal projected from the guard portion of the spool. Because tying-up portion can be enlarged, the tying-up work is more easily performed than ever before, and a dead space is eliminated. Therefore, the electromagnet device having high space efficiency is obtained.

In the electromagnet device, a step may be provided between a press-fitting portion of the coil terminal and a terminal portion of the coil terminal such that the terminal portion is protruded more than the press-fitting portion toward the direction receding from the spool.

Accordingly, because the press-fitting portion is located on a deeper side than the terminal portion, the tying-up portion extending from an edge on one side of the press-fitting portion is also located on the deeper side than the terminal portion. With this configuration, even when the tying-up portion is pushed and bent onto the guard portion side, the tying-up portion hardly overhangs from the edge of the guard portion. Therefore, the electromagnet device having the high space efficiency is obtained.

In the electromagnet device, a projection projected in the direction receding from the spool may be provided in the press-fitting portion.

Accordingly, a rear surface of the press-fitting portion is in surface contact with a press-fitting hole of the spool.

Therefore, bending work of the tying-up portion is easily performed, because looseness is not generated during pushing and bending work even when the tying-up portion is pushed and bent onto the guard portion side (inside).

In the electromagnet device, the guard portion of the spool may be provided with, on both sides of the coil being wound, at least one inclined surface inclined toward the coil terminal.

Accordingly, the lead wire of the coil is hardly disconnected, and the electromagnet device having a good yield is obtained.

In the electromagnet device, an edge of the guard portion of the spool may be provided with, at a position adjacent to the folded tying-up portion of the coil terminal, a detour projection in which the lead wire of the coil can be latched.

When the lead wire of the coil is latched in the detour projection, a tensile force does not act on the lead wire in pushing and bending the tying-up portion. Accordingly, the disconnection of the lead wire can be prevented to improve the yield.

In accordance with one or more embodiments of the present invention, an electromagnetic relay includes the electromagnet device.

Accordingly, the tying-up portion may be folded after the lead wire of the coil is tied up to the tying-up portion of the coil terminal projected from the guard portion of the spool. The tying-up work is more easily performed than ever before, and the dead space is eliminated. Therefore, the electromagnet device having the high space efficiency is advantageously obtained.

DETAILED DESCRIPTION

Embodiments of the present invention will be described with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. A self-holding electromagnetic relay to which an electromagnet device according to one or more embodiments of the present invention is applied will be described with reference to FIGS. 1A to 8.

In the following description, a term (such as terms including "up", "down", "side", and "end") indicating a specific direction or position is used as needed basis. However, the use of the term is aimed only at easy understanding of one or more embodiments of the present invention with reference to the accompanying drawings, but the technical scope of the present invention is not restricted to the meaning of the term.

Embodiments of the present invention are described as examples, but the present invention is not limited to the embodiments.

Figure 1A:
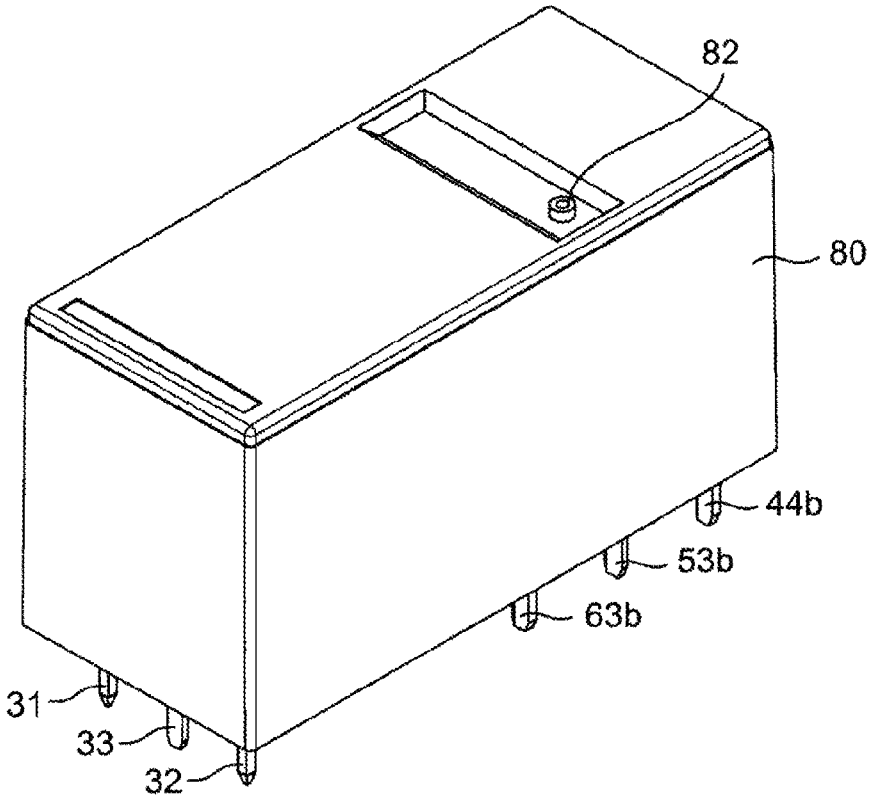
FIGS. 1A and 1B are perspective views illustrating an electromagnetic relay in which an electromagnet device according to one or more embodiments of the present invention is assembled when the electromagnetic relay is viewed from different angles.
Figure 1B:
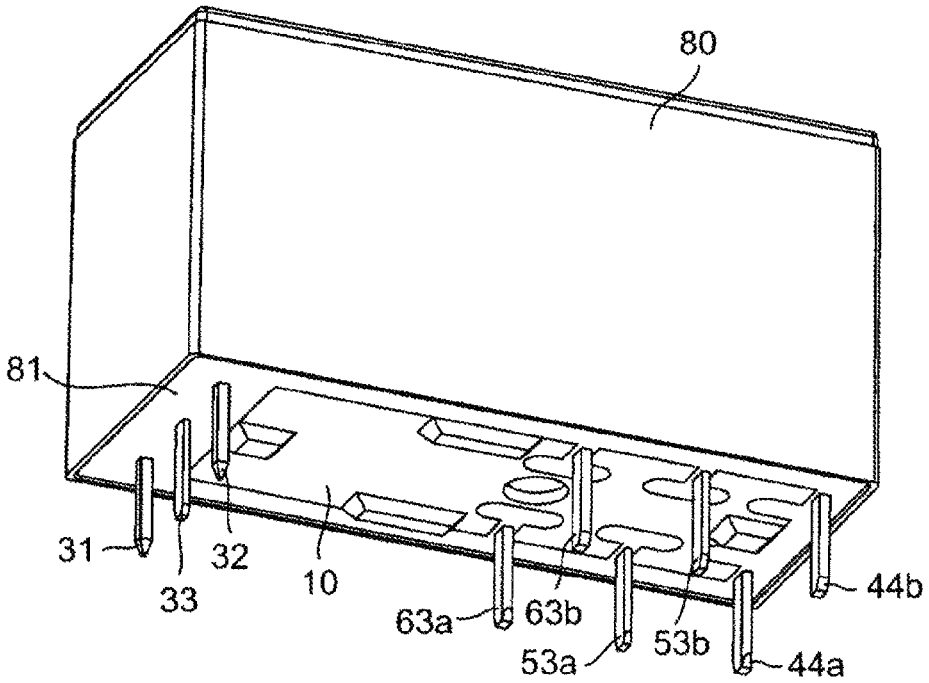
Figure 2:
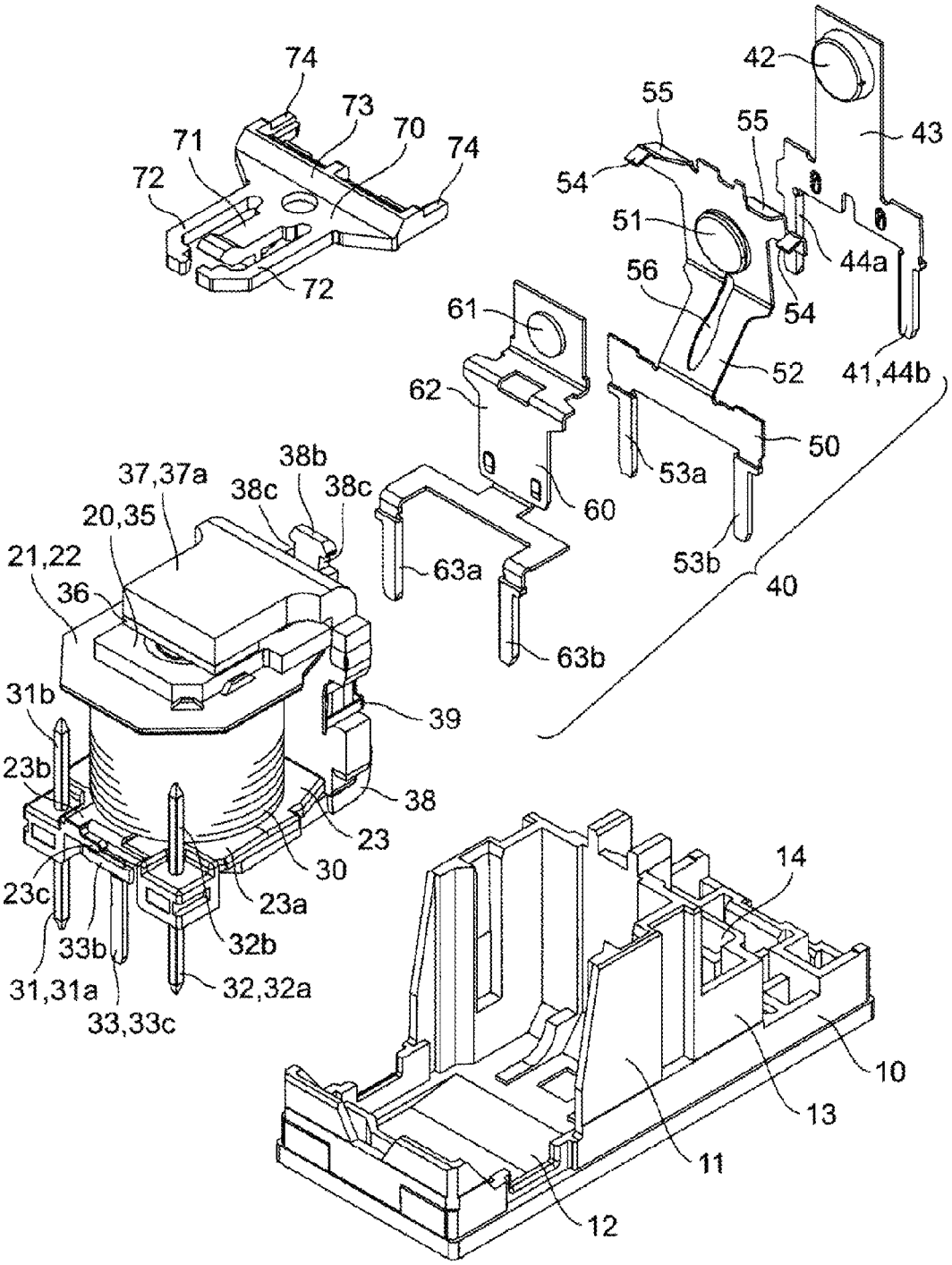
FIG. 2 is an exploded perspective view of the electromagnetic relay in FIG. 1A.
Figure 3:
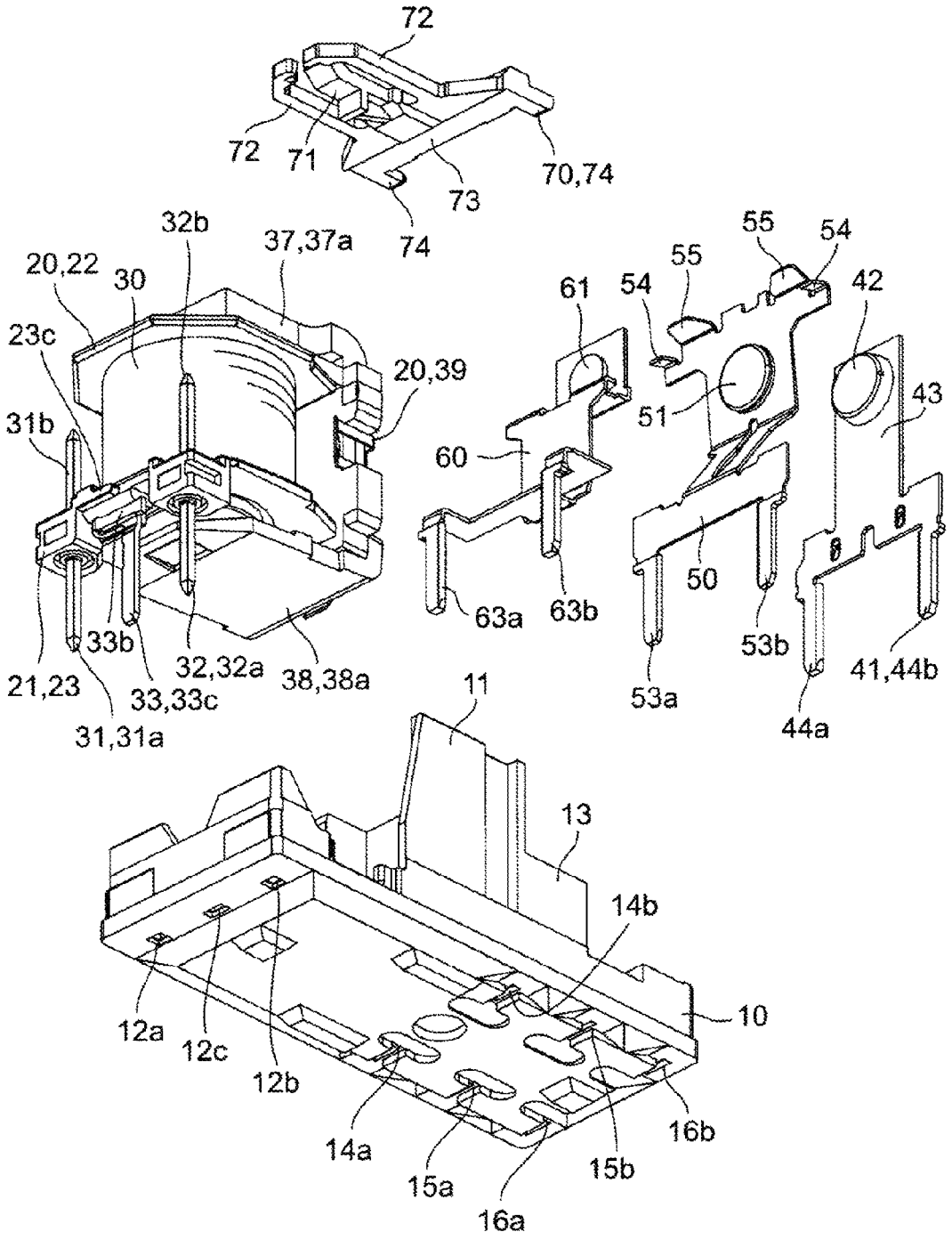
FIG. 3 is an exploded perspective view of the electromagnetic relay in FIG. 1B.

As illustrated in FIGS. 1A, 1B and 2, the electromagnetic relay according to one or more embodiments of the present invention includes base 10, electromagnet device 20, movable iron piece 38, contact mechanism 40, card 70, and box type cover 80.

In base 10, as illustrated in FIG. 2, insulating wall 11 having a gate shape in planar view is provided to stand in a center of an upper surface to form storage portion 12, and coil terminal holes 12*a*, 12*b*, and 12*c* (FIG. 3) are made in a bottom surface of storage portion 12. In base 10, fitting wall 13 having a gate shape in planar view is integrally molded so as to be adjacent to an outside surface of insulating wall 11, thereby forming fitting recess 14. A pair of terminal holes 14*a* and 14*b* (FIG. 3) is made in the bottom surface of fitting recess 14. In base 10, terminal holes 15*a* and 15*b* and terminal holes 16*a* and 16*b* (FIG. 3) are made in the bottom surface located on an outside surface side of fitting wall 13.

Figure 4:
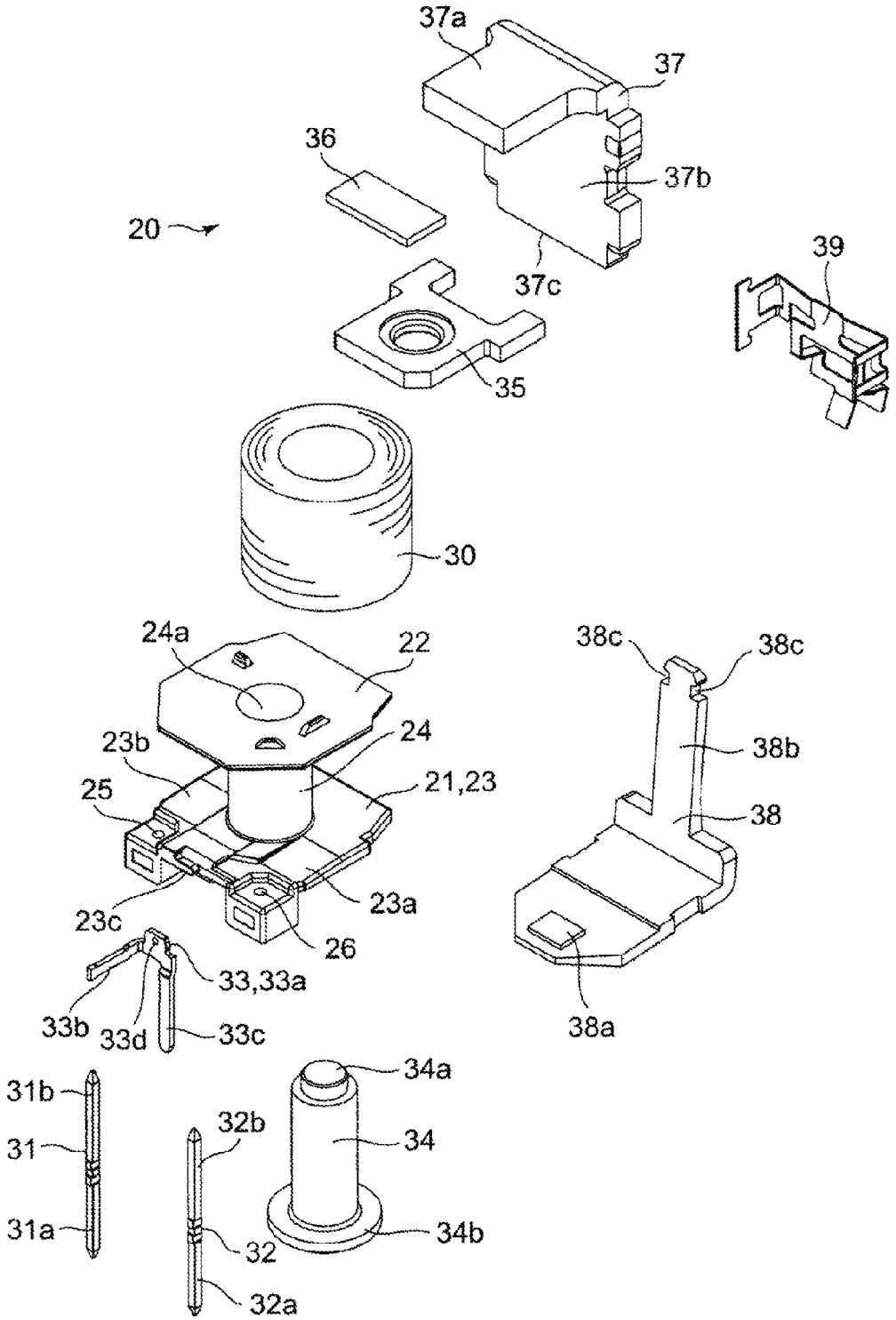
FIG. 4 is an exploded perspective view of the electromagnet device in FIG. 2.

As illustrated in FIG. 4, electromagnet device 20 is formed by winding coil 30 around body portion 24 of spool 21 including guard portions 22 and 23 at both ends. Guard portion 23 includes, on both sides of coil 30 being wound, inclined surfaces 23*a* and 23*b* inclined toward press-fitted coil terminals 31 and 32 and common coil terminal 33. Iron core 34 having a T-shape in section is inserted in through-hole 24*a* made in body portion 24, projecting one end 34*a* of iron core 34 is fixed to auxiliary yoke 35 by caulking, and the other end of iron core 34 constitutes magnetic pole portion 34*b*. In iron core 34, permanent magnet 36 is held between a leading end surface of one end 34*a* and horizontal portion 37*a* of yoke 37 having a substantial L-shape in section. Auxiliary yoke 35 abuts on an inside surface of yoke 37. Auxiliary yoke 35, yoke 37, and permanent magnet 36 form a magnetic circuit such that movable iron piece 38 does not malfunction due to an external vibration at the time of return.

Figure 5:
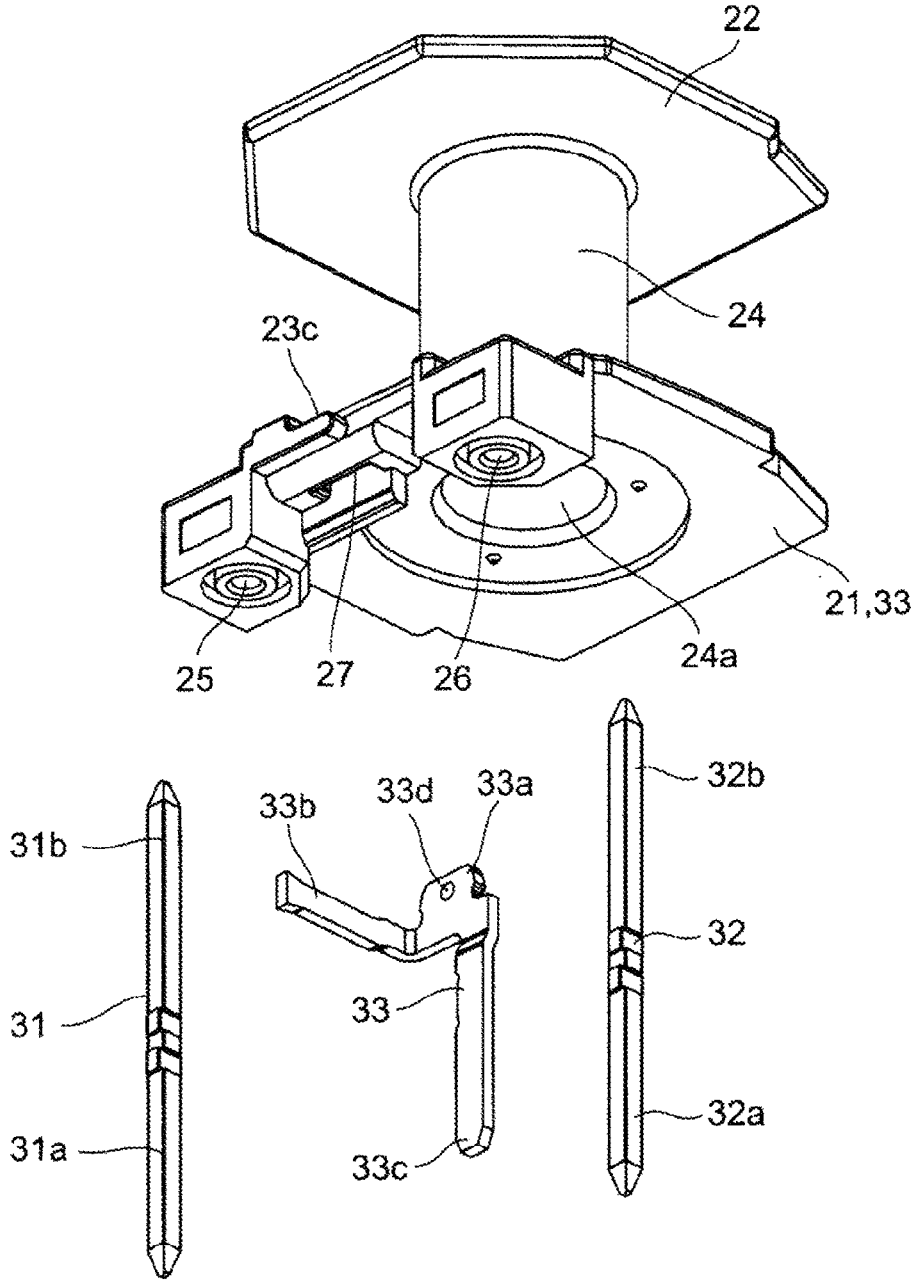
FIG. 5 is a perspective view illustrating a method for assembling the electromagnet device in FIG. 4.

In spool 21, as illustrated in FIG. 4, tying-up portions 31*b* and 32*b* of coil terminals 31 and 32 are substantially horizontally bent after straight coil terminals 31 and 32 are press-fitted in terminal holes 25 and 26 made in corner portions of guard portion 23. As illustrated in FIG. 5, press-fitting portion 33*a* of common coil terminal 33 is press-fitted in terminal hole 27 made in an outward surface of guard portion 23. Tying-up portion 33*b* of common coil terminal 33 extends in an outer peripheral direction of spool 21 (a direction receding from spool 21).

Figure 6A:
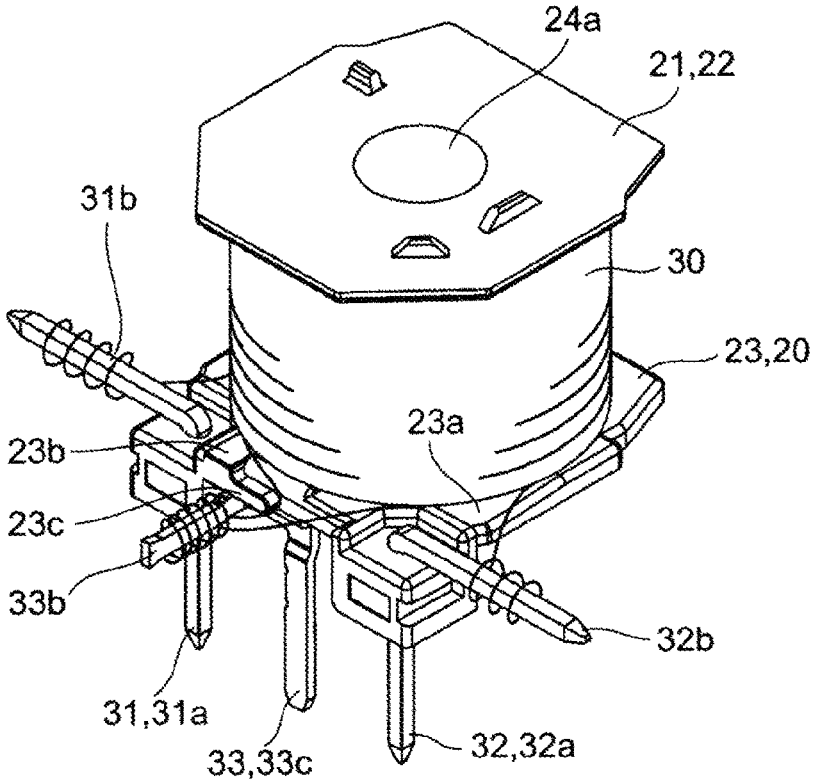
FIGS. 6A and 6B are perspective views illustrating the electromagnet device assembling method following FIG. 5.
Figure 6B:
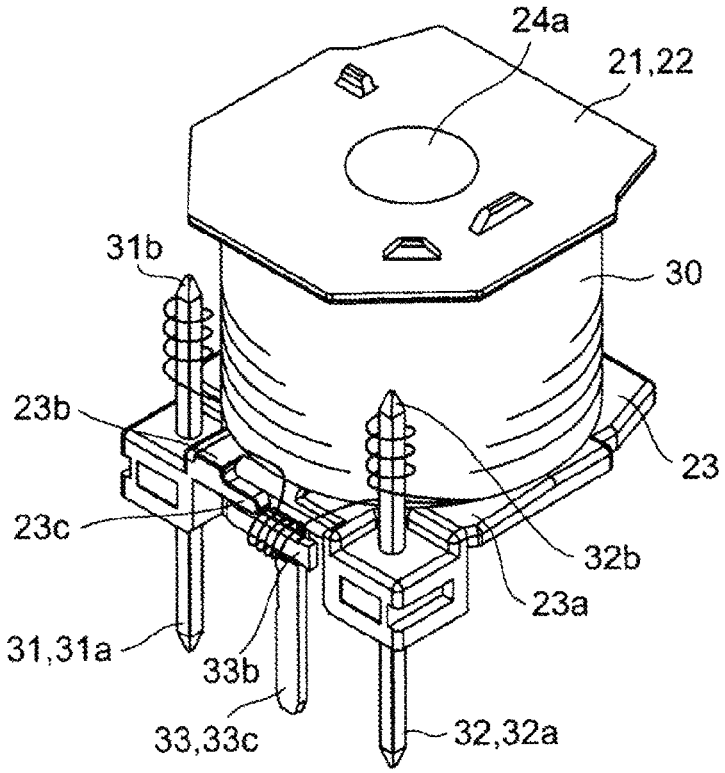

In a first winding, as illustrated in FIGS. 6A and 6B, a lead wire of coil 30 tied up to tying-up portion 33*b* of common coil terminal 33 is drawn out along inclined surface 23*b* of guard portion 23 while detouring around detour projection 23*c* provided at an edge on the side of common coil terminal 33 of guard portion 23 of spool 21. Then, after coil 30 is wound clockwise around body portion 24 by a predetermined number of windings, the lead wire of coil 30 is tied up to tying-up portion 32*b* of coil terminal 32 along inclined surface 23*a* of guard portion 23.

In a second winding, the lead wire of coil 30 tied up to tying-up portion 31*b* of coil terminal 31 is drawn along inclined surface 23*b* of guard portion 23, wound clockwise on already-wound coil 30 by a predetermined number of windings, drawn along inclined surface 23*a*, and tied up to tying-up portion 33*b* of common coil terminal 33.

After tying-up portions 31*b*, 32*b*, and 33*b* are soldered, tying-up portions 31*b* and 32*b* of coil terminals 31 and 32 are bent and raised, and tying-up portion 33*b* of common coil terminal 33 is pushed and bent toward guard portion 23 (a direction perpendicular to a lengthwise direction of spool 21).

Because detour projection 23*c* is located at a position adjacent to bent tying-up portion 33*b* of common coil terminal 33, a tensile force does not act on the lead wire of coil 30 when tying-up portion 33*b* is pushed and bent, so that disconnection of the lead wire can be prevented to improve a yield.

In one or more embodiments of the present invention, the tensile force does not act on the lead wire of coil 30 when coil terminals 31 and 32 and common coil terminal 33 are bent. Therefore, the disconnection is not generated, so that high-yield electromagnet device 20 is obtained.

In one or more embodiments of the present invention, common coil terminal 33 and coil terminals 31 and 32 are arranged along the same side of guard portion 23 of spool 21, and common coil terminal 33 is press-fitted in terminal hole 27 made in the outward surface (the surface on the side opposite to the surface in which body portion 24 is arranged) of guard portion 23. With this configuration, when coil 30 is wound around body portion 24 of spool 21, common coil terminal 33 does not disturb the winding work, so that coil 30 is wound so as to reach an outer peripheral edge of guard portion 23. Therefore, a dead space is not generated, so that the electromagnet device having high space efficiency is obtained.

Figure 7B:
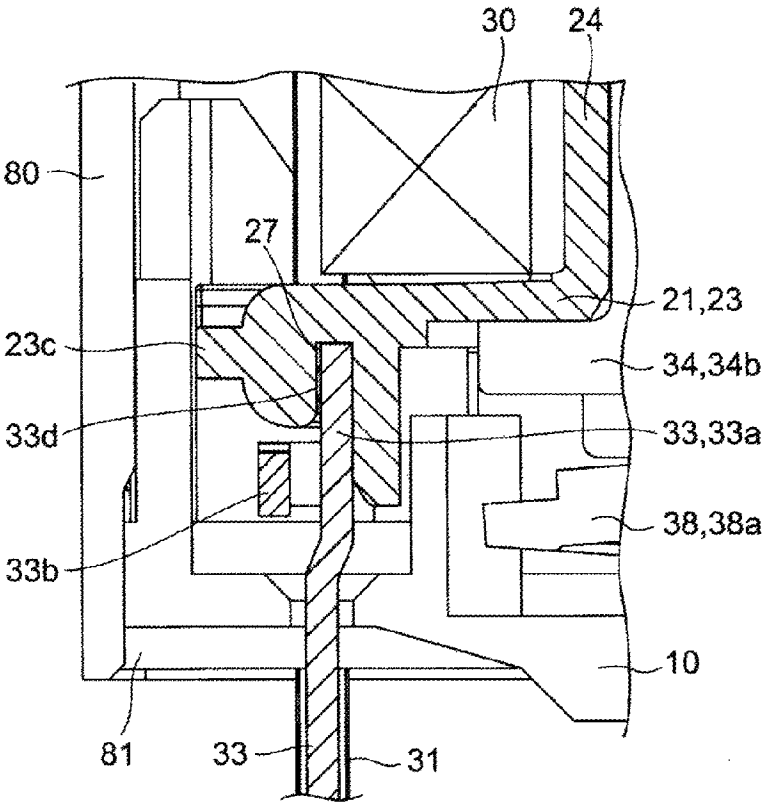
FIGS. 7A and 7B are a partially enlarged perspective view of the electromagnet device and a partially enlarged sectional view of the electromagnetic relay, respectively.
Figure 7A:
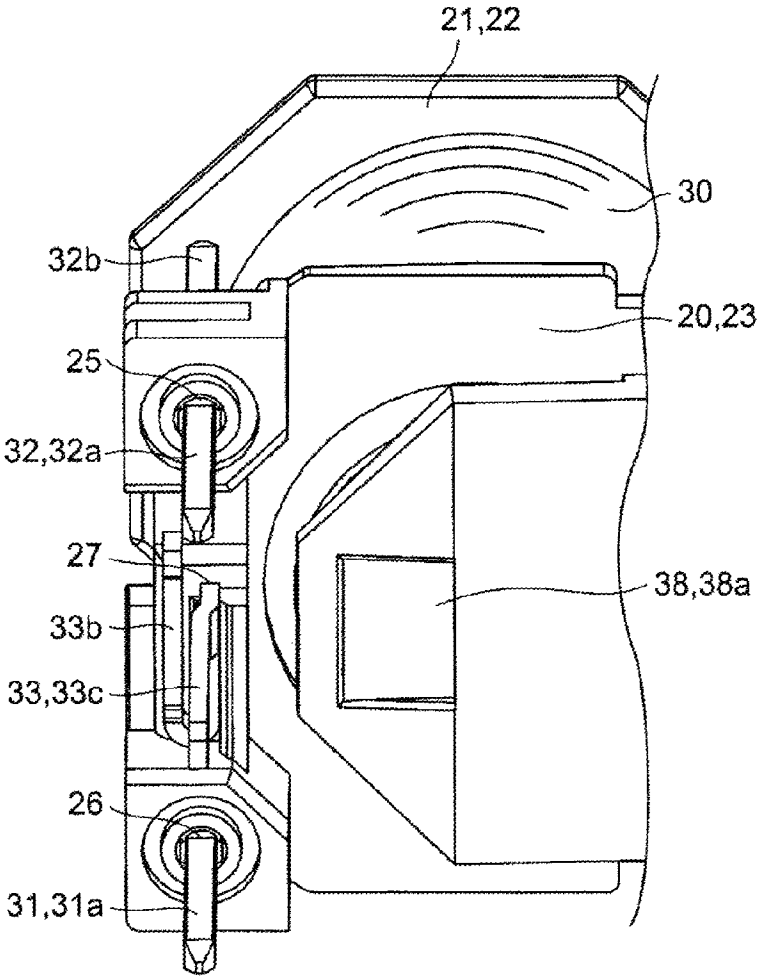

As illustrated in FIGS. 7A and 7B, terminal portion 33*c* of common coil terminal 33 is subjected to press working to form a step protruded outward (the direction receding from spool 21) than press-fitting portion 33*a*. Therefore, even when common coil terminal 33 is press-fitted in terminal hole 27 located on a deeper side than terminal holes 25 and 26, terminal portion 33*c* of common coil terminal 33 is located on the same line as terminal portions 31*a* and 32*a* of coil terminals 31 and 32, and wiring is easy to design. When tying-up portion 33*b* of common coil terminal 33 is pushed and bent onto the side of guard portion 23, a soldered free end of tying-up portion 33*b* does not overhang from the outer peripheral edge of guard portion 23 even if spring-back is slightly generated in tying-up portion 33*b*.

As illustrated in FIG. 7B, common coil terminal 33 is fitted in terminal hole 27 made in the outward surface of guard portion 23, and projection 33*d* is provided outward (the direction receding from spool 21) from press-fitting portion 33*a* of common coil terminal 33. Therefore, because a rear surface of press-fitting portion 33*a* is in surface contact with a wide inside surface of terminal hole 27, advantageously looseness is not horizontally generated even if tying-up portion 33*b* is pushed and bent.

As illustrated in FIG. 4, movable iron piece 38 is made of a magnetic material bent into a substantial L-shape in section. Movable iron piece 38 is turnably supported with lower end portion 37*c* of yoke 37 as a fulcrum by hinge spring 39 attached to edges on both sides of perpendicular portion 37*b* of yoke 37. Therefore, horizontal end portion 38*a* of movable iron piece 38 is opposed to magnetic pole portion 34*b* of iron core 34 so as to be able to come into contact with and separate from magnetic pole portion 34*b*. Notches 38*c* are provided at upper end edges of perpendicular portion 38*b* of movable iron piece 38.

As illustrated in FIG. 2, contact mechanism 40 includes fixed contact terminal 41 in which fixed contact 42 is fixed to fixed touch piece 43 by caulking, movable contact terminal 50 in which movable contact 51 is fixed to movable touch piece 52 by caulking, and fixed contact terminal 60 in which fixed contact 61 is fixed to fixed touch piece 62 by caulking.

In movable contact terminal 50, a pair of terminal portions 53*a* and 53*b* extends downward from bent movable touch piece 52 in which movable contact 51 is provided. In movable touch piece 52, position restriction tongue pieces 54 and 54 are provided by cutting and bending edges on both sides in an upper end edge, and retaining tongue pieces 55 and 55 are cut and bent between position restriction tongue pieces 54 and 54 so as to be higher than surroundings. In movable touch piece 52, slit 56 is vertically provided in order to adjust a spring constant.

Terminal portions 63*a* and 63*b* of fixed contact terminal 60 are press-fitted in terminal holes 14*a* and 14*b* made in base 10, terminal portions 53*a* and 53*b* of movable contact terminal 50 are press-fitted in terminal holes 15*a* and 15*b*, and terminal portions 44*a* and 44*b* of fixed contact terminal 41 are press-fitted in terminal holes 16*a* and 16*b*. Therefore, movable contact 51 can alternately come into contact with and separate from fixed contacts 42 and 61.

Card 70 has a substantial T-shape in planar view. In card 70, a pair of elastic arms 72 and 72 extends in parallel with each other along a narrow end portion 71 so as to be able to be engaged with notches 38*c* and 38*c* of movable iron piece 38. In card 70, aligning projections 74 and 74 are projected at edges on both sides of wide end portion 73. Wide end portion 73 is engaged between position restriction tongue pieces 54 and retaining tongue pieces 55 of movable contact terminal 50 while the pair of elastic arms 72 and 72 is engaged with notches 38*c* and 38*c* of movable iron piece 38.

Box type cover 80 has an outer shape being able to be fitted in base 10 in which electromagnet device 20 and the like are assembled. Box type cover 80 is fitted in base 10, sealing material 81 (FIG. 1B) is injected into the bottom surface of base 10 and solidified to seal the electromagnetic relay, inner air is sucked and removed through degassing hole 82 (FIG. 1A) of box type cover 80, and degassing hole 82 is heat-sealed to complete the assembly work.

Figure 8:
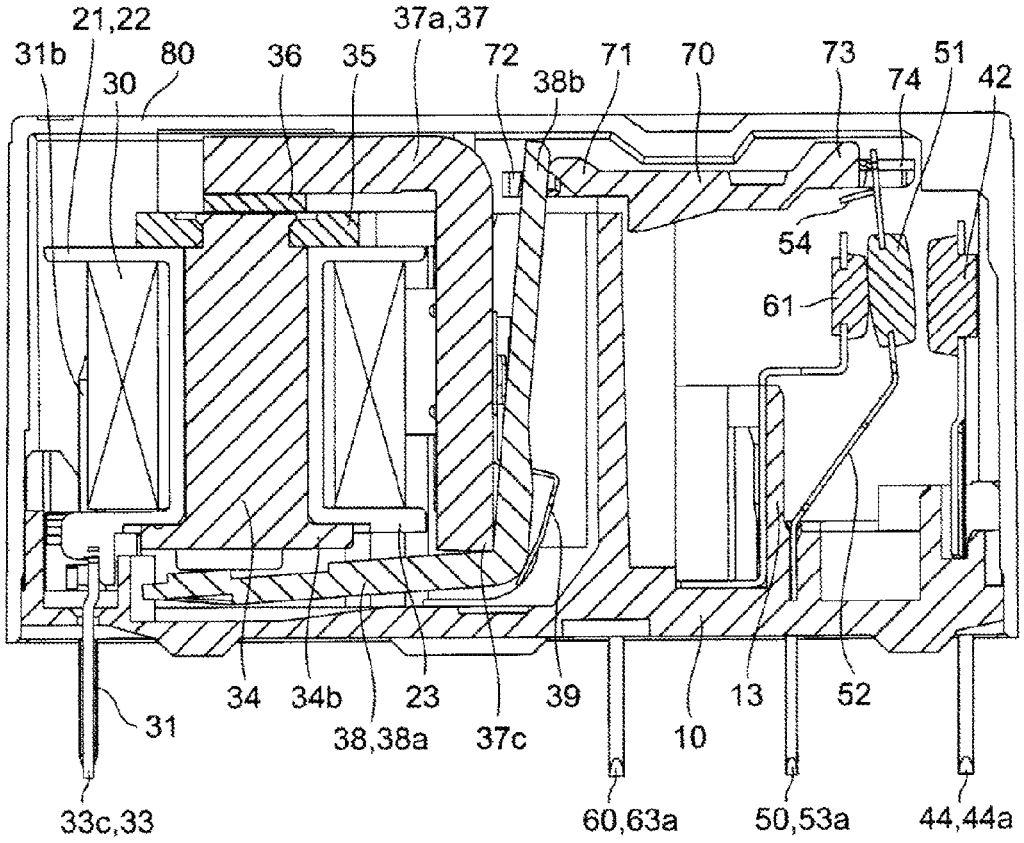
FIG. 8 is a sectional view of the electromagnetic relay in FIGS. 1A and 1B.

Operation of the electromagnetic relay will be described below with reference to FIG. 8.

In the case that a voltage is not applied to coil 30, movable iron piece 38 is pressed against card 70 by a spring force of movable touch piece 52, and movable contact 51 comes into press contact with fixed contact 61 while separating from fixed contact 42.

Then, when the voltage is applied to excite coil 30, horizontal end portion 38*a* of movable iron piece 38 is attracted to magnetic pole portion 34*b* of iron core 34, and movable iron piece 38 turns with lower end portion 37*c* of yoke 37 as the fulcrum against the spring force of movable touch piece 52. Card 70 pressed by perpendicular portion 38*b* of movable iron piece 38 moves horizontally, and presses the upper end edge of movable touch piece 52. Therefore, movable contact 51 abuts on fixed contact 42. Horizontal end portion 38*a* of movable iron piece 38 is attracted to magnetic pole portion 34*b* of iron core 34. As a result, because iron core 34, permanent magnet 36, yoke 37, and movable iron piece 38 form the closed magnetic circuit, an operating state of movable touch piece 52 is retained by a magnetic force of permanent magnet 36 even if the voltage application to coil 30 is stopped.

When the voltage is applied to coil 30 in a direction canceling out a magnetic flux of permanent magnet 36, movable iron piece 38 turns in an opposite direction by a magnetic force of coil 30 and the spring force of movable touch piece 52. Therefore, card 70 is pushed back, and movable contact 51 is opened from fixed contact 42. Then, movable contact 51 comes into press contact with fixed contact 61 and is returned. At this point, magnetic leakage is not generated because permanent magnet 36, auxiliary yoke 35, and yoke 37 form the magnetic circuit. Even if movable iron piece 38 turns due to the external vibration at the time of return, horizontal end portion 38*a* of movable iron piece 38 is not attracted to magnetic pole portion 34*b* of iron core 34, and the malfunction is not generated. Accordingly, the high-reliability electromagnetic relay is advantageously obtained.

The electromagnet device of one or more embodiments of the present invention can be applied to not only the self-holding electromagnetic relay, but also other electromagnetic relays such as a self-returning electromagnetic relay.

In the terminal attaching structure of one or more embodiments of the present invention, the coil terminal having the same shape as the common coil terminal may be used in all the coil terminals, and the coil terminal may be combined with the straight coil terminal.

By way of example, the common coil terminal is press-fitted from the direction orthogonal to the outward surface of the guard portion of the spool. Alternatively, for example, the common coil terminal may be press-fitted from the direction along the outward surface of the guard portion of the spool.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An electromagnet device comprising:

a spool comprising a guard portion at at least one end thereof;

a coil wound around a body portion of the spool; and a coil terminal press-fitted in the guard portion, wherein a lead wire of the coil is tied up to a tying-up portion of the coil terminal projected from the guard portion, wherein the tying-up portion is folded toward the guard portion of the spool with the lead wire of the coil is tied up to the tying-up portion extending in a direction perpendicular to a lengthwise direction of the spool, wherein the guard portion of the spool is provided with, on both sides of the coil being wound, at least one inclined surface inclined toward the coil terminal, and wherein the lead wire of the coil tied up to the tying-up portion is drawn out along the inclined surface.

2. The electromagnet device according to claim 1, wherein a step is provided between a press-fitting portion of the coil terminal and a terminal portion of the coil terminal such that the terminal portion is protruded more than the press-fitting portion toward a direction receding from the spool.

3. The electromagnet device according to claim 2, wherein the guard portion of the spool is provided with, on both sides of the coil being wound, at least one inclined surface inclined toward the coil terminal.

4. The electromagnet device according to claim 2, wherein an edge of the guard portion of the spool is provided with, at a position adjacent to the folded tying-up portion of the coil terminal, a detour projection in which the lead wire of the coil can be latched.

5. An electromagnetic relay comprising the electromagnet device according to claim 2.

6. The electromagnet device according to claim 1, wherein a projection projected in the direction receding from the spool is provided in the press-fitting portion.

7. The electromagnet device according to claim 6, wherein the guard portion of the spool is provided with, on both sides of the coil being wound, at least one inclined surface inclined toward the coil terminal.

8. The electromagnet device according to claim 6, wherein an edge of the guard portion of the spool is provided with, at a position adjacent to the folded tying-up portion of the coil terminal, a detour projection in which the lead wire of the coil can be latched.

9. An electromagnetic relay comprising the electromagnet device according to claim 6.

10. The electromagnet device according to claim 1, wherein an edge of the guard portion of the spool is provided with, at a position adjacent to the folded tying-up portion of the coil terminal, a detour projection in which the lead wire of the coil can be latched.

11. An electromagnetic relay comprising the electromagnet device according to claim 10.

12. An electromagnetic relay comprising the electromagnet device according to claim 1.

13. The electromagnet device according to claim 1, wherein a projection projected in the direction receding from the spool is provided in the press-fitting portion.

* * * * *